US012723009B2

(12) United States Patent
Van Driel

(10) Patent No.: US 12,723,009 B2
(45) Date of Patent: Sep. 1, 2026

(54) PROPELLANT CHARGE

(71) Applicant: Nederlandse Organisatie voor toegepast-natuurwetenschappelijk onderzoek TNO, 's-Gravenhage (NL)

(72) Inventor: Christoffel Adrianus Van Driel, Delft (NL)

(73) Assignee: Nederlandse Organisatie voor toegepast-natuurwetenschappeliijkonderzoek TNO, 's-Gravenhage (NL)

( * ) Notice: Subject to any disclaimer, the term of this patent is extended or adjusted under 35 U.S.C. 154(b) by 103 days.

(21) Appl. No.: 18/949,068

(22) Filed: Nov. 15, 2024

(65) Prior Publication Data

US 2025/0128997 A1 Apr. 24, 2025

Related U.S. Application Data

(62) Division of application No. 16/770,763, filed as application No. PCT/NL2018/050827 on Dec. 10, 2018, now abandoned.

(30) Foreign Application Priority Data

Dec. 8, 2017 (NL) ..... 17206158.2

(51) Int. Cl.
*C06B 21/00* (2006.01)
*C06B 45/12* (2006.01)

(52) U.S. Cl.
CPC ..... *C06B 21/0083* (2013.01); *C06B 45/12* (2013.01)

(58) Field of Classification Search
None
See application file for complete search history.

(56) References Cited

U.S. PATENT DOCUMENTS 1,627,861 A 5/1927 O'Neil
4,089,716 A * 5/1978 Goddard ..... C06B 47/10 149/9
4,106,960 A 8/1978 Brachert et al.
(Continued)

FOREIGN PATENT DOCUMENTS

DE 10046146 A1 3/2001
GB 836546 A 6/1960
GB 1204659 A 9/1970

*Primary Examiner* — Aileen B Felton
(74) *Attorney, Agent, or Firm* — Hoffmann & Baron, LLP

(57) ABSTRACT

The invention is directed to a propellant charge for guns, to a combination of a propellant charge and a primer, to a firearms cartridge, and to a method for modifying the surface of a propellant charge.

The propellant charge of the invention comprises multiple propellant grains, wherein an exterior part of part of the propellant grains has been subjected to a surface modification treatment comprising the successive steps of suspending propellant grains in water to prepare a slurry,
adding an organic solvent to the propellant grains before, after and/or during the preparation of the slurry,
mixing the slurry that comprises water and organic solvent for a period of 120 minutes or less,
lowering the concentration of organic solvent,
removing organic solvent, and
drying the propellant grains to remove water;

wherein part of the propellant grains has not been subjected to the surface modification treatment.

17 Claims, 3 Drawing Sheets

(56) References Cited

U.S. PATENT DOCUMENTS

| | | | | |
|---|---|---|---|---|
| 4,650,617 | A * | 3/1987 | Kristofferson | C06B 21/0025 149/19.92 |
| 5,682,009 | A | 10/1997 | O'Meara et al. | |
| 2002/0134269 | A1 * | 9/2002 | Fahrni | C06B 21/0083 102/289 |

* cited by examiner

1A

1B

2A

2C

2B

2D

3A untreated part treated part

3B untreated part treated part untreated part treated part

PROPELLANT CHARGE

CROSS-REFERENCE TO RELATED APPLICATIONS

This application is a Divisional of U.S. patent application Ser. No. 16/770,763, filed Jun. 8, 2020, which claims priority from U.S. National Phase of International Patent Application Number PCT/NL2018/050827 filed Dec. 10, 2018, which claims priority to NL 17206158.2 filed Dec. 8, 2017, each of which is incorporated herein by reference.

BACKGROUND OF THE INVENTION

The invention is directed to propellant charges for guns, to a combination of a propellant charge and a primer, to a firearms cartridge, and to methods for modifying the surface of propellant grains.

Propellant charges for conventional barrel weapon systems should be configured such that they can function safely and without problems under different environmental conditions. Temperature differences during the weapon deployment represent an important influence, which must be taken into account when developing propellant charges.

According to the laws of physics, the combustion rate of a propellant charge depends on the spontaneous ignition temperature and the starting temperature of the propellant. This relationship leads to the typical characteristic of traditional propellant powders that the linear burn rate more or less depends on the starting temperature. From this, it necessarily follows that the maximum gas pressure and the muzzle velocity have a more or less steep temperature gradient. The temperature dependent performance of such propellant powders has considerable disadvantages, for example a considerably lower projectile energy during the deployment at normal and at low temperatures, and, because the hit accuracy usually depends on the projectile velocity influencing the barrel jump, low first hit probability. More specifically, the projectile velocity will be higher when the ammunition temperature is higher and lower when the ammunition temperature is lower.

It is much more favourable to have a propellant charge with temperature independent behaviour, in that the weapon performance (and in particular the projectile velocity) is more or less equal regardless of the ammunition temperature. The main advantage thereof is the fact that the performance of the weapon over the entire temperature range can be improved. This is because the propellant charge is usually dimensioned to the highest possible weapons performance having the highest gas pressures in the weapon. Further, the accuracy is improved in comparison to conventional munition.

In the art, there have been some attempts in providing a propellant with temperature independent behaviour when employed in a weapon.

U.S. Pat. No. 1,627,861, for instance, reveals the preparation of a propellant powder having a dense core and a modified surface.

GB-A-1 204 659 discloses a process of preparing porous nitrocellulose powder, comprising the formation of pores by removal of water-soluble salts from the propellant grains.

DE-A-100 46 146 describes a propellant powder comprising at least one in situ polymerised surface treatment agent in the surface layer of the grain surface.

GB-A-836 546 discloses a method of preparing propellant powder having a porous interior and a dense outer layer. The grains are subjected to prolonged impregnation with nitroglycerin and ethyl acetate.

U.S. Pat. No. 5,682,009 describes a treatment process to influence the burn rate of the propellant by using a burn rate modifier.

U.S. Pat. No. 4,106,960 discloses a temperature compensating propellant charge, wherein individual powder particles of nitrocellulose containing propellant are coated with an acrylic resin having a molecular weight between 100 000 and 200 000 g/mol, the coating comprising 10 to 20% by weight of the propellant.

DE-A-196 35 795 describes a propellant charge for tube weapons with a main charge and a transmission charge wherein the transmission charge has burning characteristics which are opposite to those of the main charge.

A similar solution is provided by EP-A-0 150 431, which discloses a propellant charge for tube weapons with a mixture of homogeneous powder having a burn rate which increases with increasing temperature, and heterogeneous powder (or HET-powder) having a burn rate which decreases with increasing temperature.

US-A-2002/0 134 269, US-A-2006/0 266 451 and EP-A-1 241 152 describe a propellant powder wherein plugs are formed inside the perforations of perforated propellant grains. As a result, the propellant grains burn practically independent of the propellant powder temperature. If the propellant powder temperature is high (resulting in a fast combustion rate), the plugs remain inside the perforation tunnels and a minimum surface is available for the burning. With a low temperature (slow combustion rate), the plugs are all removed by the ignition pressure wave and a maximum surface area is available for the burning. This solution is somewhat complex and is not applicable to spherical propellant charges.

Despite these attempts, there remains a need for alternative and improved propellant charges that allow temperature independent performance in a weapon.

SUMMARY OF THE INVENTION

An objective of the present invention is to overcome at least some of the disadvantages observed in the prior art and to provide such an improved propellant charge.

The inventors surprisingly found that this objective can be met by subjecting at least some propellant grains in a propellant charge to a surface modification treatment.

Accordingly, in a first aspect, the invention is directed to a propellant charge, comprising multiple propellant grains, wherein an exterior part of part of the propellant grains has been subjected to a surface modification treatment comprising the successive steps of

- suspending propellant grains in water to prepare a slurry,
- adding an organic solvent to the propellant grains before, after and/or during the preparation of the slurry,
- mixing the slurry that comprises water and organic solvent for a period of 120 minutes or less,
- optionally removing water and/or organic solvent,
- lowering the concentration of organic solvent,
- removing organic solvent, and
- drying the propellant grains to remove water wherein part of the propellant grains has not been subjected to the surface modification treatment.

The inventors found that the temperature dependence of the performance of a propellant charge of the invention is surprisingly reduced. As a result, the propellant charge as claimed can be employed in a weapon at various temperatures while maintaining sufficient accuracy.

Alternatively, treatment of the propellant charges can be performed in vapour phase. In such a treatment, the water and organic solvent are not mixed in a slurry but mix in vapour or gas phase.

Therefore, in a further aspect, the invention is directed to a propellant charge, comprising multiple propellant grains, wherein an exterior part of part of the propellant grains has been subjected to a surface modification treatment comprising the successive steps of wetting propellant grains with water or water vapour,
adding an organic solvent to the propellant grains before, after and/or during the wetting of the propellant grains,
allowing the wet propellant grains and the organic solvent to interact for a period of 120 minutes or less,
optionally removing water and/or organic solvent,
lowering the concentration of organic solvent,
removing organic solvent, and
drying the propellant grains to remove water wherein part of the propellant grains has not been subjected to the surface modification treatment.

DETAILED DESCRIPTION

Figure 1:
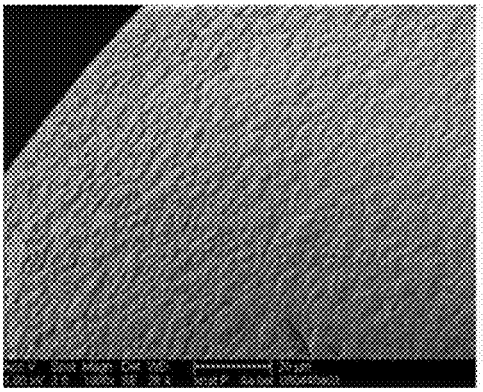
FIG. 1. Scanning electron microscope images of this comparison are shown in FIG. 1. The picture shown in FIG. 1A shows microscopic images of the spherical propellant grains before treatment, whereas the picture shown in FIG. 1B shows microscopic images of the spherical propellant grains after treatment. Clearly, the treatment has structurally changed the spherical propellant grains.
Figure 1:
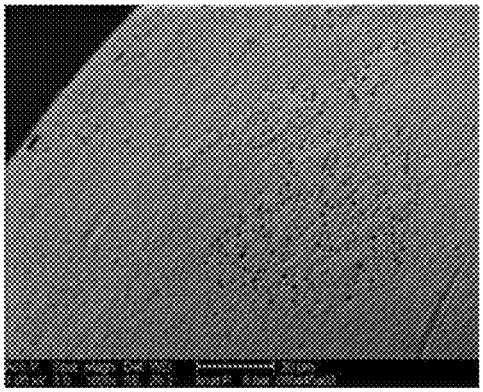

The term "propellant" as used in this application is meant to refer to any suitable type of combustible material adapted to generate gases to propel a projectile from a gun barrel weapons. The propellant can include a single type of material or multiple types of materials and, with multiple types of materials, the materials can be arranged in any suitable type of uniform, non-uniform, or patterned configurations. The materials can also be provided as powder, unary, solidified liquid, etc.

The term "propellant charge" as used in this application is typically meant to refer to the equally common designations "gun powder" or "gun propellant", but is also intended to encompass pyrotechnical charges. A propellant charge typically comprises a plurality of particulate grains (or propellant grains). When used in ammunition, the propellant charge is normally contained within a metal or combustible case (in case of modern modular charges for artillery systems), or cloth bag. For small arms, the individual grains of a propellant charge can, for instance, be spherical (spherical propellants), cylindrical, or cubical. Small arms propellant charges can have diameters of a few hundred microns. For larger guns, such as artillery pieces, the individual grains typically have diameters up to about one and a half centimetres and lengths of up to about 3 cm.

The term "propellant grain" as used in this application is meant to refer to a single mass of propellant. Hence, in a spherical propellant a grain refers to a single sphere or ball, and in a perforated propellant a grain refers to a single perforated mass of propellant.

The term "primer" as used in this application is meant to refer to any suitable type of initiating charge adapted to initiate combustion of the main propellant charge.

Without wishing to be bound by any theory, the inventors believe that the surface modification treatment results in a propellant charge, wherein surface modified part of the propellant grains has different burn properties than the part of the propellant grains that is not modified (such as propellant grains that are not surface modified, or the interior part of the propellant grains). The inventors believe that the temperature sensitivity of the modified surface is larger than the temperature sensitivity of non-modified part of the propellant charge. At high temperatures, the projectile that is to be shot will be accelerated quickly initially by the fast burning surface modified part of the propellant charge, thereby increasing the chamber volume and avoiding extremely high pressures in the chamber when the majority of the non-modified part of the propellant charge burns. Hence, the initial increase in chamber volume compensates for the higher burn rate of the non-modified propellant charge. At low temperatures, the projectile that is to be shot will be accelerated slowly thereby maintaining the chamber volume small which allows a quick pressure build-up to compensate for the lower burn rate. It is not yet fully understood how the burn characteristics of the propellant charge are influenced by the surface modification. Possible features that may play a role are the porosity of the propellant charge at the surface, the degree of gelation of propellant constituents like nitrocellulose, and/or another redistribution of propellant ingredients at a molecular scale.

The propellant charge of the invention comprises multiple propellant grains. The type of grains (i.e. spherical propellants or perforated extruded propellants) in the propellant charge is usually the same. The propellant charge may, for instance, comprise one or more selected from black powder, nitroglycerin, nitroguanidine, bis-nitroxyethylnitramine (DINA), fivonite (tetramethylolcyclopentanone tetranitrate), diethylene glycol dinitrate (DGN), acetyl cellulose, LOVA-propellant. As commonly known in the art, the acronym LOVA stands for LOw Vulnerability Ammunition and such propellants comprise a solid energetic filler in a polymeric binder system (see e.g. Agrawal, "High Energy Materials, Propellants, Explosives and Pyrotechnics", Wiley-VCH, 2010, Weinheim, 228-230). Typically, the propellant charge comprises nitrocellulose and/or LOVA-propellant. More preferably, the propellant charge comprises nitrocellulose.

Propellant charges that comprise nitrocellulose can be divided into single-base, double-base, triple-base, and quadruple-base, or multibase compositions. Conventional granular, nitrocellulose-based propellant compositions typically include nitrocellulose, selected organic plasticisers for use as ballistic modifiers, stabilisers, and other additives such as inorganic salts or carbon black. When energetic plasticisers such as nitroglycerin (NG) or diethylene glycol dinitrate (DEGDN) are also added, the propellant is considered a "double base" propellant. Such an addition of energetic plasticisers within the propellant provides an effective means to enhance the energy content of the charge as well as the flame temperature of the combustion gases and thereby increase performance of the propellant. Thus, a "single-base" propellant contains nitrocellulose with optional additives. A "double-base" propellant contains nitrocellulose as well as an additional energetic plasticiser. A "triple-base" propellant generally contains nitrocellulose, energetic plasticisers, and another solid component, such as nitroguanidine (NQ).

The nitrocellulose content in single-base compositions is 90% or more by total weight of the composition. The nitrocellulose content in double-base compositions is typically 50-90% by total weight of the composition. The nitrocellulose content in triple-base compositions is typically 40-50% by total weight of the composition. It is also possible that the propellant charge comprises RDX (cyclotrimethylene trinitramine) and/or HMX (cyclotetramethylene tetranitramine), and nitrocellulose is used as a binder. The RDX and/or HMX content is then typically 10-30% by total weight of the composition, and the nitrocellulose content is typically 90% or less by total weight of the composition. Such propellant charges can further comprise other energetic solid components such as triaminoguanidine nitrate (TAGN), hexanitrohexa-aza-isowurtzitane (HNIW), n-guanylurea-dinitramide, 1,1-diamino-2,2-dinitro-ethylene (DADNE), and/or non-energetic plasticisers.

The production of conventional single-base, double-base, or triple-base propellant compositions is known in the art.

The method of the invention may also be effective for compositions that are poor in nitrocellulose, such as composite propellants that contain 70% or more by total weight of the composition of RDX or other solid energetic materials.

If necessary, the propellant can contain additives for thermochemical stabilisation, barrel protection, plasticising, gun flash damping, improving ignition behaviour and/or, burning modulation.

Known additives for increasing stabilisation are, for example, Acardit II (CAS No. 724-18-5), Centralit I (CAS No. 90-93-7), Centralit II (CAS No. 611-92-7), 2-nitrodiphenylamine, and diphenylamine.

Known additives for barrel protection are, for example, talcum, titanium dioxide, calcium carbonate, and magnesium silicate.

Known additives for plasticising, for example, camphor dibutyl phthalate, dioctyl phthalate, acetyl triethyl citrate, acetyl tributyl citrate, tributyl citrate, dibutyl adipate, diethyl adipate, dioctyl adipate, diethyl sebacate, dibutyl sebacate, and the like.

Known additives for gun flash damping are, for example, potassium sulphate and potassium cryolite.

These additives may be added, either alone or in combination, to the propellant powder dough while preparing the untreated propellant grain and are thus distributed homogeneously in the propellant grain matrix. The total amount of additives in the untreated propellant grain can suitably be between 0-10% by total weight of the grain, such as 0.1-5%. It is also possible to introduce one or more additives during the surface modification treatment, as will be explained.

According to the invention an exterior part of part of the propellant grains in the propellant charge has been subjected to a surface modification treatment. In accordance with the invention, part of the propellant grains have been subjected to the surface modification treatment, while another part of the propellant grains has not been subjected to the surface modification treatment. As a result, the invention may suitably be applied to spherical propellant, wherein part of the balls is surface modified, while another part of the balls is not surface modified. The weight ratio of surface modified spherical propellant to non-surface modified spherical propellant can be in the range of 20:80 to 80:20, preferably 35:65 to 65:35 and more preferably 45:55 to 55:45.

In an embodiment of the surface modification treatment for surface modifying at least part of the propellant grains, the grains are suspended in water to prepare a slurry. Besides water, it is also possible to use an aqueous solution. The aqueous solution can comprise components such as emulsion additives, salts, surface active agents like gelatine, colloid stabilisers, and combinations thereof. Salts, such as $K_2SO_4$, may for instance be used to retract water before distilling off organic solvent. Typically, the amount of water or aqueous solution used is 0.5-20 litre per kilogram of propellant grains, such as 1-10 litre, or 1-5 litre per kilogram of propellant grains.

The slurry may be agitated to form a homogeneous mixture. Optionally, the slurry may be heated to a temperature in the range of 30-80° C., such as in the range of 40-70° C.

In another embodiment of the surface modification treatment for surface modifying at least part of the propellant grains, the grains are wetted with water or water vapour. In this embodiment the water or water vapour may comprise additional further components as mentioned above for the aqueous solution.

In a further step, an organic solvent is added to the propellant grains. This can be done before, after and/or during preparation of the slurry, or before, after and/or during wetting of the propellant grains. Preferably, the organic solvent is added to the propellant after and/or during preparation of the slurry, or after and/or during wetting of the propellant grains. It is thus, for example, possible to add a mixture of organic solvent and water to the propellant grains so as to prepare a slurry with water, but also to first prepare the slurry with water and afterwards add organic solvent. Likewise, it is possible to first wet the propellant grains with a mixture of organic solvent and water, but also to first wet the propellant grains with water and afterwards add organic solvent.

In the accordance with the first aspect of the invention, the organic solvent is preferably added in liquid form.

Preferably, the organic solvent is a solvent that forms a two phase system with water. The formation of a two phase system may aid in preventing coagulation of propellant grains. The organic solvent is preferably more volatile than water. For example, the vapour pressure of the organic solvent at 25° C. can be 10 kPa or more, such as 10-500 kPa, or 12-400 kPa.

Suitable examples of possible organic solvents include methyl acetate, ethyl acetate, isopropyl acetate, isobutyl acetate, t-butyl acetate, isopropyl ether, t-butyl methyl ether, ethyl ether, acetone, methyl ethyl ketone, methyl isobutyl ketone, methyl isopropyl ketone, 2-butanone, 3-pentanone, 4-methyl-2-pentanone, 3,3-dimethyl-2-butanone, methyl formate, ethyl formate, propyl formate, acetol, 1,4-dioxane, 2,2-dimethoxy propane, acetonitrile and tetrahydrofuran. Preferably, the organic solvent comprises one or more selected from ethyl acetate, methyl ethyl ketone, isopropyl acetate.

The amount of organic solvent to be added may be 50-500 ml per litre of total slurry excluding the organic solvent, such as 80-350 ml per litre of total slurry excluding the organic solvent, or 100-250 ml per litre of slurry excluding the organic solvent.

In accordance with the second aspect of the invention, the organic solvent can be added in vapour or gas form. The amount of organic solvent to be added can then be 1-100 ml per kg of wet propellant grains excluding the organic solvent, such as 2-80 ml per kg of wet propellant grains excluding the organic solvent, or 5-50 ml per kg of wet propellant grains excluding the organic solvent.

Optionally, the organic solvent may comprise further components, such as one or more deterrents for slowing down the burn rate, or one or more stabilisers. Suitable deterrents can for example be selected from the group consisting of centralites (symmetrical diphenyl urea, primarily diethyl or dimethyl), dibutyl phthalate, dinitrotoluene, akardite (asymmetrical diphenyl urea), ortho-tolyl urethane, polyester adipate, and camphor.

The total amount of additional components in the organic solvent can suitably be in the range of 0.01-5% by total weight of the organic solvent inclusive additional components, such as 0.2-3%, or 0.3-1%.

Further optional additives that may be added to the organic solvent include nitroglycerine (NG), diethylene glycol dinitrate (DEGDN), n-butyl-2-nitratoethyl-nitramine (butyl-NENA), ethyl-2-nitratoethyl-nitramine (ethyl-NENA), and other energetic plasticisers.

The addition of the organic solvent may involve spraying of the organic solvent so as to homogeneously distribute the organic solvent over the propellant grains or over the slurry. In case the organic solvent is added as a vapour or gas, this is not critical. The solvent may be added to the propellant grains continuously at a relatively slow rate in order to avoid localised areas which contain high concentrations of the solvent capable of completely dissolving the propellant grains. The addition of the organic solvent may, for instance, be performed at a rate of 5-75 ml per litre slurry excluding the organic solvent, such as 10-50 ml per litre slurry excluding the organic solvent, or 12-25 ml per litre slurry excluding the organic solvent. Typically, the addition of the organic solvent is completed within a period of 1-30 minutes, preferably 2-10 minutes. It is preferred that the propellant grains or the slurry is agitated while adding the organic solvent.

During the addition of the organic solvent, the temperature can be maintained in the range of 0-70° C., such as in the range of 10-40° C.

After having added the organic solvent, the slurry or the mixture of wet propellant grains and organic solvent is mixed, or allowed to interact, for a period of 120 minutes or less. This period of time typically ranges from 15-120 minutes, preferably 20-100 minutes, such as 30-90 minutes. During mixing, the temperature of the slurry can be 0-70° C., such as 10-40° C.

In an optional step, an amount of water and/or organic solvent is removed. Such removal can, for example, involve decanting. The optional removal of water and/or organic solvent may be performed to remove excess water and/or organic solvent. Accordingly, the removal suitably involves removing part of the water and/or part of the organic solvent.

Subsequently, the concentration of organic solvent is lowered. This may, for instance, be realised by adding an additional amount of water or water vapour to the mixture. This additional amount of water is preferably added within 5-120 minutes from having added the organic solvent, such as within 15-75 minutes.

The additional amount of water is preferably an amount of 250-1500 ml per litre of total slurry, such as 350-1100 ml per litre of total slurry, or 500-800 ml per litre of total slurry. Suitably, the additional amount of water is 50-700% by weight of the initial amount of water, preferably 100-500% by weight, such as 175-450% by weight.

If an additional amount of water or water vapour is added to the mixture of wet propellant grains and organic solvent, the additional amount of water or water vapour is preferably added within 5-120 minutes from having added the organic solvent, such as within 15-75 minutes. In this embodiment, the additional amount of water is preferably an amount of 5-50 g per kg of wet propellant grains, preferably 8-40 g per kg of wet propellant grains, or 10-35 g per kg of wet propellant grains. Suitably, the additional amount of water is 2-20% by weight of the initial amount of water, preferably 4-12% by weight, such as 5-10% by weight.

Another way of lowering the concentration of organic solvent may be by evaporation of organic solvent, such as evaporation part of the organic solvent. At the same time such evaporation of organic solvent will result in removal of organic solvent, as required in the next step of the method of the invention. Accordingly, these two steps can be combined into a single step of solvent evaporation.

Without wishing to be bound by any theory, the inventors believe that upon addition of the organic solvent, the exterior surface of the propellant grains is softened because the propellant slightly dissolves in the organic solvent. The organic solvent is believed to somewhat penetrate the propellant grain, thereby taking some water along. The exterior part of the grain then comprises propellant in a mixture of water and organic solvent. Upon lowering the concentration of organic solvent, such as by adding an additional amount of water, organic solvent is believed to be drawn from the propellant grain, leaving water. Due to low solubility of propellant in water, this is believed to induce phase separation between propellant and water or a water phase, causing the formation of small water droplets in a propellant matrix.

The slurry or mixture may be agitated for 0-90 minutes, such as 10-60 minutes, before organic solvent is removed, such as by evaporation, distillation and/or heating. If the slurry or mixture is agitated for too long, then the burn rate of the propellant grains will become undesirably high due to too large a decrease in density of the propellant.

It is preferred that substantially all of the organic solvent is removed. The removal of organic solvent may involve distillation. The temperature at which distillation is performed may depend on the type of organic solvent that is used, but can typically be in the range of 80-105° C., such as 90-99° C. Typically, the distilling temperature is below the boiling point of water.

Finally, the propellant grains are dried to remove water. Drying may involve heating, but removing water by other means, such as filtration, is also considered a form of drying.

The surface modification treatment that is required in accordance with the invention causes a physical-chemical change in the structure of a part (the surface layer) of the propellant grains. Accordingly, the treated propellant grains of the invention may be structurally distinguished from non-treated propellant grains. This may, for instance, be determined using scanning electron microscopy.

For small and medium calibre weapons, the propellant charge of the invention may either be in the form of a spherical propellant charge having multiple spherical propellant grains, or small cylindrical grains. Spherical propellant grains are typically small spherical balls of propellant material. Cylindrical grains may be provided with longitudinal perforations.

For larger calibre weapons, the propellant charge typically comprises cylindrical grains with an external diameter of, for example, 1-20 mm, preferably 3-15 mm. The propellant grain geometry can also be different. For example, it can have a rosette shape or a hexagonal shape. The propellant grains may be provided with longitudinal perforations. The number of perforations in the propellant grain is dependent on the gas evolution rate desired. Advantageously, the propellant grains are provided with 7 to 19 holes extending through in axial direction. The ratio of propellant grain length to propellant grain diameter is normally in the range of 0.3-5.0, preferably 0.8-2.5. The ratio of the hole diameter to the grain diameter is normally in the range of 0.01-0.5, for example, and in particular in the range of 0.03-0.2.

Untreated extruded propellant grains can be produced in a manner known in the art by compressing a solvent-containing or solvent-free propellant powder dough or propellant powder pack with or without additive in an extruder or by means of extrusion. Untreated ball propellant grains can be produced in a manner known in the art in a slurry-in-water process.

In a further aspect, the invention is directed to a combination of a propellant charge and a primer, wherein said propellant charge is a propellant charge according to the invention. The amount of said primer can be in the range of 1-10% by total weight of the main propellant charge, preferably 1.5-9%, such as 2-8%.

The function of the primer is to generate gaseous products and/or hot particles. It has been found advantageous in terms of the invention to use the propellant charge of the invention in combination with a strong primer charge, which produces a larger amount of gases than usual. Primer strength may, for instance, be expressed as the time that is required from the first gas generation of the primer until 10% of the total pressure has built up. In accordance with the invention this time may be in the range of 0.2-10 ms, such as 0.5-20 ms instead of 1-50 ms for usual systems. This required time from the first gas generation of the primer until 10% of the total pressure has built up depends on calibre. For example, for medium calibre munition (such as 35 mm munition) this time can be in the range of 0.2-5 ms, such as 1.5-3 ms. For large calibre munition (such as 127 mm calibre) this time can be in the range of 5-50 ms, such as 8-15 ms.

In yet a further aspect, the invention is directed to a firearms cartridge comprising a combination of a propellant charge and a primer as described herein.

In yet a further aspect, the invention is directed to a method for modifying the surface of propellant grains, wherein said method comprises the successive steps of suspending propellant grains in water to prepare a slurry,
adding an organic solvent to the propellant grains before, after and/or during the preparation of the slurry,
mixing the slurry that comprises water and organic solvent for a period of 120 minutes or less,
optionally removing water and/or organic solvent,
lowering the concentration of organic solvent,
removing organic solvent, and
drying the propellant grains to remove water.

In yet a further aspect, the invention is directed to a method for modifying the surface of propellant grains, wherein said method comprises the successive steps of wetting propellant grains with water or water vapour,
adding an organic solvent to the propellant grains before, after and/or during the wetting of the propellant grains,
allowing the wet propellant grains and the organic solvent to interact for a period of 120 minutes or less,
optionally removing water and/or organic solvent,
lowering the concentration of organic solvent,
removing organic solvent, and
drying the propellant grains to remove water.

Details of these methods are as described above for the propellant charge of the invention.

Using this method, it is possible to prepare a propellant charge according to the invention by subjecting part of the propellant grains that are used for preparing the propellant charge to the described method. Hence, in an additional step of the above two methods for modifying the surface of propellant grains, the resulting modified propellant grains can be mixed with non-modified propellant grains to prepare a propellant charge according to the invention.

The method is a cheap and easily reproducible method for surface treatment of propellant charges.

The invention has been described by reference to various embodiments, compositions and methods. The skilled person understands that features of various embodiments, compositions and methods can be combined with each other. For instance, preferred coating compositions can be used in the various methods, in the same way preferred steps of a method can be combined with each other and with preferred coating compositions.

All references cited herein are hereby completely incorporated by reference to the same extent as if each reference were individually and specifically indicated to be incorporated by reference and were set forth in its entirety herein.

The use of the terms "a" and "an" and "the" and similar referents in the context of describing the invention (especially in the context of the claims) are to be construed to cover both the singular and the plural, unless otherwise indicated herein or clearly contradicted by context. The terms "comprising", "having", "including" and "containing" are to be construed as open-ended terms (i.e., meaning "including, but not limited to") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention. For the purpose of the description and of the appended claims, except where otherwise indicated, all numbers expressing amounts, quantities, percentages, and so forth, are to be understood as being modified in all instances by the term "about". Also, all ranges include any combination of the maximum and minimum points disclosed and include any intermediate ranges therein, which may or may not be specifically enumerated herein.

Preferred embodiments of this invention are described herein. Variation of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject-matter recited in the claims appended hereto as permitted by applicable law. Moreover, any combination of the above-described elements in all possible variations thereof is encompassed by the invention unless otherwise indicated herein or otherwise clearly contradicted by context. The claims are to be construed to include alternative embodiments to the extent permitted by the prior art.

For the purpose of clarity and a concise description features are described herein as part of the same or separate embodiments, however, it will be appreciated that the scope of the invention may include embodiments having combinations of all or some of the features described.

The invention will now be further illustrated by the following examples, which are not intended to limit the scope of protection in any manner.

EXAMPLES

Example 1—Spherical Propellant Grains (10 Wt. % of Nitroglycerine)

Spherical propellant grains containing 10 wt. % of nitroglycerine and nitrocellulose and additives were suspended in a 3:1 weight ratio mixture of ethanol and water to prepare a slurry. The slurry was mixed for 30 minutes. The concentration of organic solvent was lowered by evaporation of organic solvent. The spherical propellant grains were then dried in air. The spherical propellant grains before treatment were compared with the surface treated spherical propellant grains.

Scanning electron microscope images of this comparison are shown in FIG. 1. The picture shown in FIG. 1A shows microscopic images of the spherical propellant grains before treatment, whereas the picture shown in FIG. 1B shows microscopic images of the spherical propellant grains after treatment. Clearly, the treatment has structurally changed the spherical propellant grains.

Example 2—Extruded Double Base Propellant Grains (Nitroglycerine and Diethyleneglycol Dinitrate)

Extruded double base propellant grains containing nitroglycerine and diethylene glycol dinitrate were suspended in a 1:1 weight ratio mixture of acetone and water to prepare a slurry. The slurry was mixed for 30 minutes. The concentration of organic solvent was lowered by evaporation of organic solvent. The spherical propellant grains were then dried in air. The extruded double base propellant grains before treatment were compared with the surface treated extruded double base propellant grains.

Figure 2:
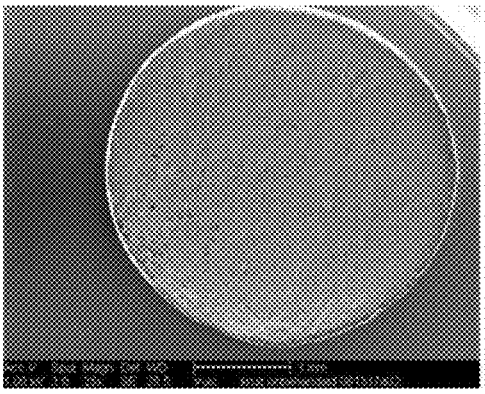
FIG. 2 Scanning electron microscope images of this comparison are shown in FIG. 2. The pictures shown in FIGS. 2A and 2B show microscopic images of the extruded double base propellant grains before treatment, whereas the pictures shown in FIGS. 2C and 2D show microscopic images of the extruded double base propellant grains after treatment. Clearly, the treatment has structurally changed the extruded double base propellant grains.
Figure 2:
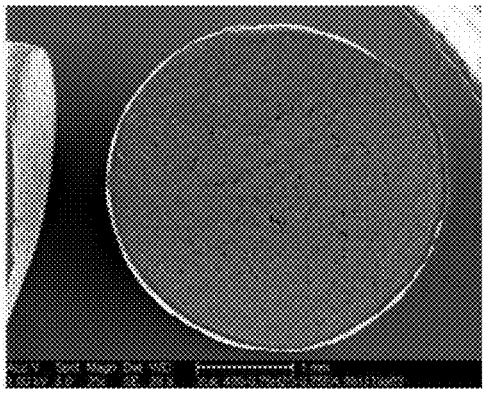
Figure 2:
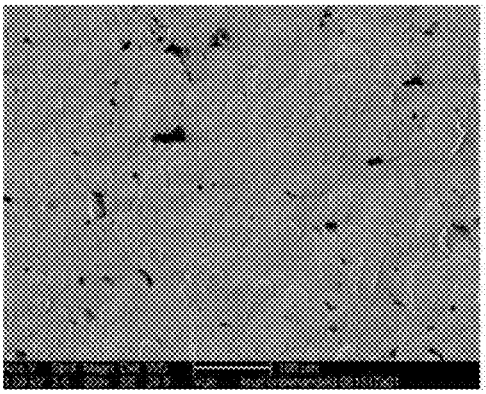
Figure 2:
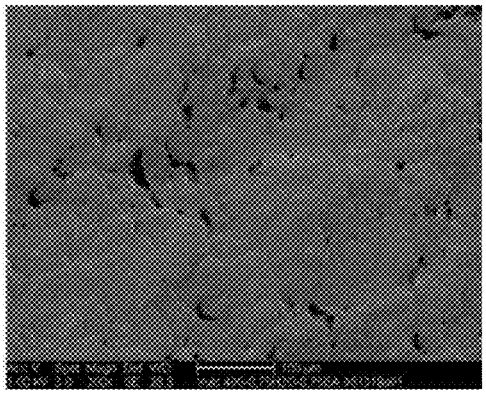

Scanning electron microscope images of this comparison are shown in FIG. 2. The pictures shown in FIGS. 2A and 2B show microscopic images of the extruded double base propellant grains before treatment, whereas the pictures shown in FIGS. 2C and 2D show microscopic images of the extruded double base propellant grains after treatment. Clearly, the treatment has structurally changed the extruded double base propellant grains.

Example 3—Film of Material of Spherical Propellant Grains (10 wt. % of Nitroglycerine)

Spherical propellant grains containing 10 wt. % of nitroglycerine and nitrocellulose and additives as used in example 1 were dissolved in acetone. A film of the propellant material was prepared by evaporation of the acetone. This film was used for subsequent treatment.

Part of the film was submersed in a 1:1 weight ratio mixture of acetone and water for a period of 30 minutes. Thereafter, the film was dried in air.

Figure 3:
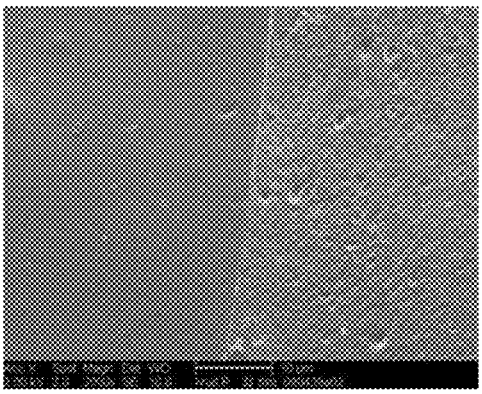
FIG. 3. Scanning electron microscope images were made showing the boundary line between the untreated part and the treated part of the film, as shown in FIGS. 3A and 3B. Clearly, the treatment has structurally changed the material of the spherical propellant grains. The same structural change is expected to occur on spherical propellant grains that are subjected to the treatment of the invention.
Figure 3:
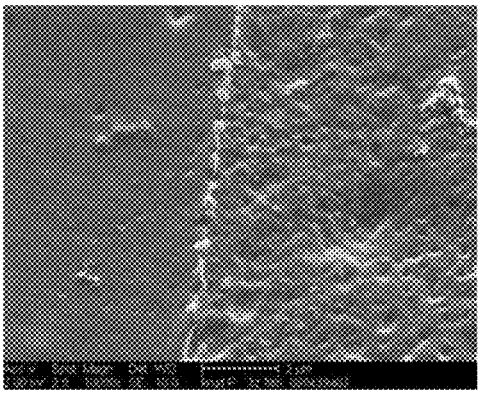

Scanning electron microscope images were made showing the boundary line between the untreated part and the treated part of the film, as shown in FIGS. 3A and 3B. Clearly, the treatment has structurally changed the material of the spherical propellant grains. The same structural change is expected to occur on spherical propellant grains that are subjected to the treatment of the invention.

Example 4—Film of Material of Extruded Double Base Propellant Grains (Nitroglycerine and Diethyleneglycol Dinitrate)

Extruded double base propellant grains containing nitroglycerine and diethylene glycol dinitrate as used in example 2 were dissolved in acetone. A film of the propellant material was prepared by evaporation of the acetone. This film was used for subsequent treatment.

Part of the film was submersed in a 1:1 weight ratio mixture of acetone and water for a period of 30 minutes. Thereafter, the film was dried in air.

Figure 4:
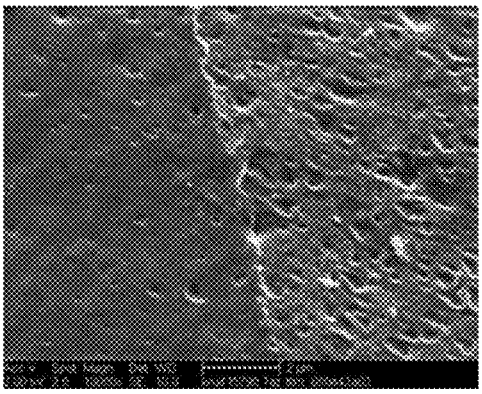
FIG. 4. Scanning electron microscope images were made showing the boundary line between the untreated part and the treated part of the film, as shown in FIG. 4. Clearly, the treatment has structurally changed the material of the extruded double base propellant grains propellant grains. The same structural change is expected to occur on extruded double base propellant grains that are subjected to the treatment of the invention.

Scanning electron microscope images were made showing the boundary line between the untreated part and the treated part of the film, as shown in FIG. 4. Clearly, the treatment has structurally changed the material of the extruded double base propellant grains propellant grains. The same structural change is expected to occur on extruded double base propellant grains that are subjected to the treatment of the invention.

Example 5—12.7 mm Ammunition With Spherical Double Base

Figure 5:
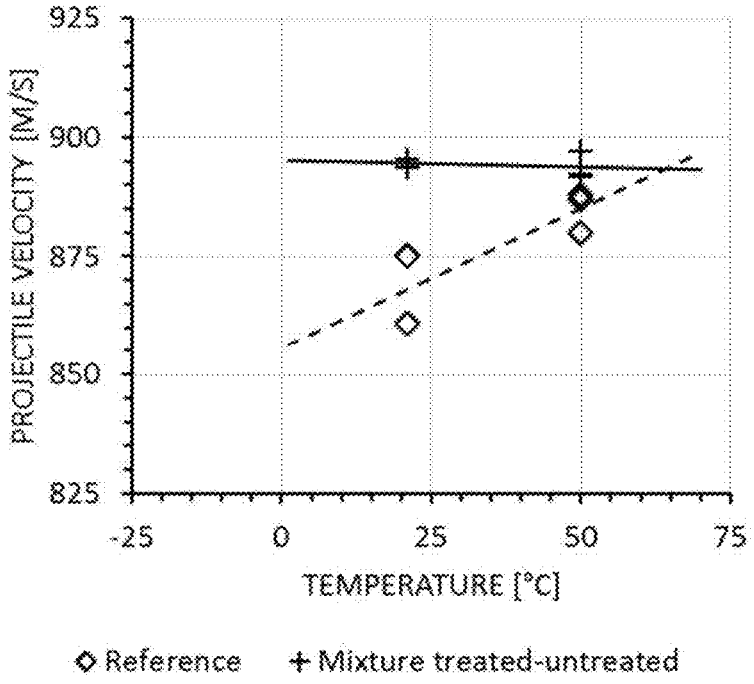
FIG. 5. shows the resulting graph in which the projectile velocity in case of the treated propellant grains is clearly less dependent on temperature than the projectile velocity in case of the untreated propellant grains.

Temperature dependency of untreated and treated propellant grains was determined by measuring projectile velocity of munition fired from a conventional 12.7 mm caliber barrel weapon as a function of temperature. The munition was filled with double base propellant having a spherical propellant grain geometry. The treated part of the propellant mixture of untreated and treated propellant had been treated with an ethyl acetate-water mixture. The treated part of the propellant mixture of untreated and treated propellant had been treated by suspending propellant grains in water, adding ethyl acetate to the obtained slurry, mixing this slurry for 1 hour, lowering the concentration of ethyl acetate by adding more water, distilling off the ethyl acetate, and drying the treated propellant. FIG. 5 shows the resulting graph in which the projectile velocity in case of the treated propellant grains is clearly less dependent on temperature than the projectile velocity in case of the untreated propellant grains.

Figure 6:
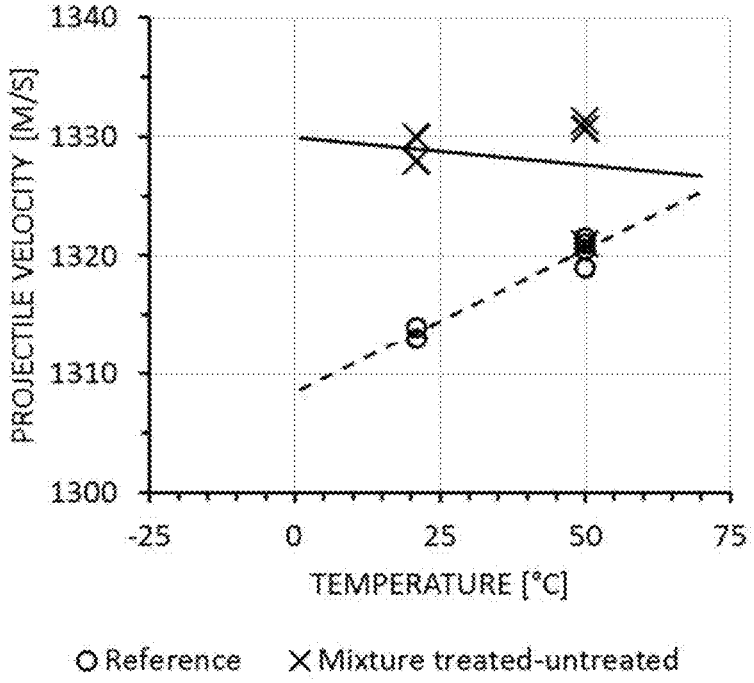
FIG. 6. shows the resulting graph in which the projectile velocity in case of the treated propellant grains is clearly less dependent on temperature than the projectile velocity in case of the untreated propellant grains.

Example 6—25 mm Ammunition With Extruded Single Perforated Single Base Propellant Temperature dependency of untreated and treated propellant grains was determined by measuring projectile velocity of munition fired from a conventional 25 mm caliber barrel weapon as a function of temperature. The munition was filled with extruded single base propellant with a single perforated propellant grain geometry. The treated part of the propellant mixture of untreated and treated propellant had been treated by wetting propellant grains with an ethanol-water mixture during 30 minutes in a rotating drum after which the solvent and the water were removed by drying. FIG. 6 shows the resulting graph in which the projectile velocity in case of the treated propellant grains is clearly less dependent on temperature than the projectile velocity in case of the untreated propellant grains.

The invention claimed is:

1. A method for modifying the surface of propellant grains, wherein said method comprises the successive steps of suspending propellant grains in water to prepare a slurry, adding an organic solvent to the propellant grains before, after and/or during the preparation of the slurry, mixing the slurry that comprises water and organic solvent for a period of 120 minutes or less, lowering the concentration of organic solvent, removing organic solvent, and drying the propellant grains to remove water so as to obtain surface modified propellant grains, wherein said surface modified propellant grains are combined with a primer, wherein the time required from the first gas generation of the primer until 10% of the total pressure has built up is in the range of 0.2-20 ms.

2. The method of claim 1, wherein said primer is present in an amount in the range of 1-10% by total weight of the main propellant charge.

3. The method of claim 1, wherein the organic solvent is added to the propellant grains before the preparation of the slurry.

4. The method of claim 1, wherein the organic solvent is added to the propellant grains after the preparation of the slurry.

5. The method of claim 1, wherein the organic solvent is added to the propellant grains during the preparation of the slurry.

6. The method of claim 1, wherein the surface modification treatment further comprises removing water and/or organic solvent after mixing the slurry that comprises water and organic solvent for a period of 120 minutes or less and before lowering the concentration of organic solvent.

7. The method of claim 1, wherein the propellant grains comprise nitrocellulose.

8. The method of claim 1, wherein the propellant grains comprise LOVA-propellant.

9. The method of claim 1, wherein the organic solvent is more volatile than water.

10. The method of claim 1, wherein the organic solvent comprises one or more selected from methyl acetate, ethyl acetate, isopropyl acetate, isobutyl acetate, t-butyl acetate, isopropyl ether, t-butyl methyl ether, ethyl ether, acetone, methyl ethyl ketone, methyl isobutyl ketone, methyl isopropyl ketone, 2-butanone, 3-pentanone, 4-methyl-2-pentanone, 3,3-dimethyl-2-butanone, methyl formate, ethyl formate, propyl formate, acetol, 1,4-dioxane, 2,2-dimethoxy propane, acetonitrile and tetrahydrofuran.

11. The method of claim 1, wherein the period of time is from 15-120 minutes.

12. The method of claim 1, wherein said lowering of the concentration of organic solvent is performed by adding an additional amount of water.

13. The method of claim 12, wherein the additional amount of water is 50-700% by weight of the initial amount of water.

14. The method of claim 12, wherein the additional amount of water is 100-500% by weight of the initial amount of water.

15. The method of claim 12, wherein the additional amount of water is 175-450% by weight of the initial amount of water.

16. The method of claim 1, wherein the propellant charge is in the form of a spherical propellant charge or a rifle propellant.

17. The method of claim 1, wherein the surface modified propellant grains are mixed with non-modified propellant grains before combining with the primer.

* * * * *